US005734627A

United States Patent [19]

Sy

[11] Patent Number: 5,734,627

[45] Date of Patent: Mar. 31, 1998

[54] SILHOUETTE IMAGE ON ILLUMINATED WATCH DIAL

[75] Inventor: Rogelio T. Sy, Cebu, Philippines

[73] Assignee: Timex Corporation, Middlebury, Conn.

[21] Appl. No.: 753,625

[22] Filed: Nov. 27, 1996

[51] Int. Cl.[6] ..... G04B 19/30; G04B 19/32; H01J 1/62; H05B 33/10

[52] U.S. Cl. ..... 368/67; 368/226; 368/227; 368/232; 313/113; 313/510; 362/23; 445/24

[58] Field of Search ..... 368/67, 223–237; 313/110–113, 502, 503, 506, 509, 510, 513; 362/23, 24; 445/23, 24

[56] References Cited

U.S. PATENT DOCUMENTS

| | | | |
|---|---|---|---|
| 502,161 | 7/1893 | Alderson . | |
| 618,646 | 1/1899 | Crane . | |
| 2,362,754 | 1/1944 | Johnson | 58/2 |
| 3,321,905 | 5/1967 | Krebs | 58/50 |
| 4,229,783 | 10/1980 | Eberhardt | 362/352 |
| 4,747,086 | 5/1988 | Shaw | 368/239 |
| 4,775,964 | 10/1988 | Alessio et al. | 368/67 |
| 4,832,459 | 5/1989 | Harper et al. | 350/345 |
| 5,117,334 | 5/1992 | Kameda | 362/28 |
| 5,150,257 | 9/1992 | Mohabbatizadeh et al. | 359/601 |
| 5,265,071 | 11/1993 | Thorgersen | 368/67 |
| 5,426,621 | 6/1995 | Akasaka | 368/226 |
| 5,513,153 | 4/1996 | Thorgersen et al. | 368/227 |
| 5,620,348 | 4/1997 | Santana et al. | 445/24 |

*Primary Examiner*—Vit W. Miska
*Attorney, Agent, or Firm*—William C. Crutcher

[57] ABSTRACT

An electroluminescent watch dial is provided with silhouette images on the dial. A transflective film covers an opaque image layer applied to a conventional electroluminescent watch dial. Timekeeping indicia are applied over the transflective film. The image is not seen in ambient light but is visible when the electroluminescent lamp is actuated.

7 Claims, 2 Drawing Sheets

SILHOUETTE IMAGE ON ILLUMINATED WATCH DIAL

BACKGROUND OF THE INVENTION

This invention relates generally to improvements in illuminated dials for timepieces and more particularly to an improved electroluminescent lamp for a timepiece which provides a silhouette image when the lamp is lit.

A prior art illuminated dial for a timepiece is disclosed in U.S. Pat. No. 4,775,964 issued Oct. 4, 1988 to Alessio et al. and assigned to the Applicant's assignee. This prior art illuminated dial is shown in FIG. 1 of the drawing, where the timepiece dial comprises the substrate on which electroluminescent (EL) layer elements are deposited. As shown in FIG. 1, the timepiece case 2 contains the watch hands 3, 4 mounted upon coaxial rotating stems 10, 11, connected to a watch movement 12. The case 2 includes a transparent crystal 13 through which to observe the hands 3, 4 and their position in relation to indicia 8, 9 on the dial 7. An electroluminescent drive circuit 14 supplies drive pulses via output leads 15, serving as means for selectively illuminating the timepiece dial. Dial 7 is mounted in case 2 by means of an insulating gasket 16, which electrically insulates it from case 2.

Dial 7 comprises a transparent substrate 17 of Mylar™ film having an electrically conductive transparent layer 18 of indium tin oxide (ITO). A phosphor/binder electroluminescent layer 19 is applied to layer 18. The EL layer 19 comprises encapsulated phosphor particles in a polymerized suspension medium. A layer 20 of insulating dielectric material having reflective qualities, such as barium titanate, is deposited onto layer 19, and lastly a conductive electrode layer 21 of metallic aluminum is applied on top of layer 20 by vapor deposition. Timekeeping indicia 8, 9 are printed on the opposite side of substrate 17, and circumferentially spaced around the periphery of the dial 7. The aforementioned dial 7 is provided with a central aperture 22 for accommodating the rotatable stems 10, 11. The leads 15 are connected to electrodes 18, 21 at connection points **15*a*, 15*b* respectively of dial 7, which is electrically floating with respect to the grounded watch case 2**.

The timekeeping indicia 8, 9 are visible in the daytime by reflection of the ambient light to the eye of the viewer. The indicia 8, 9 are also visible when the electroluminescent layer 19 is illuminated, since the indicia are opaque so as to block the light and appear as dark images on a lighted background.

Another type of illuminated dial which is not selectively illuminated is described in U.S. Pat. No. 5,426,621 issued Jun. 20, 1995 to Akasaka. There a plate is coated with a phosphorescent maintaining luminous agent of rare-earth metal oxide and covered with a translucent member which may have timekeeping indicia on either its upper or lower surface. The indicia are visible against the background of the continuous phosphorescence beneath. Various methods of producing the timekeeping indicia are discussed, including photoetching patterns from a very thin metal plate. However there is no provision for selective display, and the time period of luminescence is limited.

U.S. Pat. No. 4,747,086 issued May 24, 1988 to Shaw discloses a selectively illuminated fluorescent display. A thin mercury transflective coating is applied to the underside of the lens over the display, causing the lens to reflect ambient light and act as a mirror. When the display is actuated, conventional timekeeping indicia are viewable through the lens.

It may be desirable to include images on the dial in addition to the timekeeping indicia. Such images might consist of designs, logos or pictures on the watch dial for advertising, entertainment or other purposes. However, the user of the timepiece may not wish the images to appear at all times.

Accordingly, one object of the invention is to provide an improved timepiece dial which permits selective display of images on the dial.

Another object of the invention is to provide an improved electroluminescent timepiece dial with an illuminated silhouette image.

SUMMARY OF THE INVENTION

Briefly stated the invention is practiced by providing a timepiece dial with an illuminated silhouette image, comprising an electroluminescent lamp adapted to serve as the dial for the timepiece and having an upper surface, means to selectively illuminate the lamp, a silhouette image comprising an opaque object covering a portion of the upper surface, a transflective layer covering both the upper surface and the silhouette image, and opaque timekeeping indicia disposed on the transflective layer.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

FIG. 1 is an elevation drawing in cross section of a prior art electroluminescent lamp, FIG. 2 is an elevational view in cross section of an electroluminescent lamp according to the present invention, FIG. 3 is a simplified top plan view of the timepiece dial of FIG. 2 during daylight hours, FIG. 4 is a top plan view of the same timepiece dial of FIG. 2 when the dial is illuminated, FIG. 5 is a simplified side elevational view in cross section illustrating the operation of FIG. 3, and FIG. 6 is a simplified side elevational view in cross section illustrating the operation of FIG. 4.

DESCRIPTION OF THE PREFERRED EMBODIMENT

Figure 1:
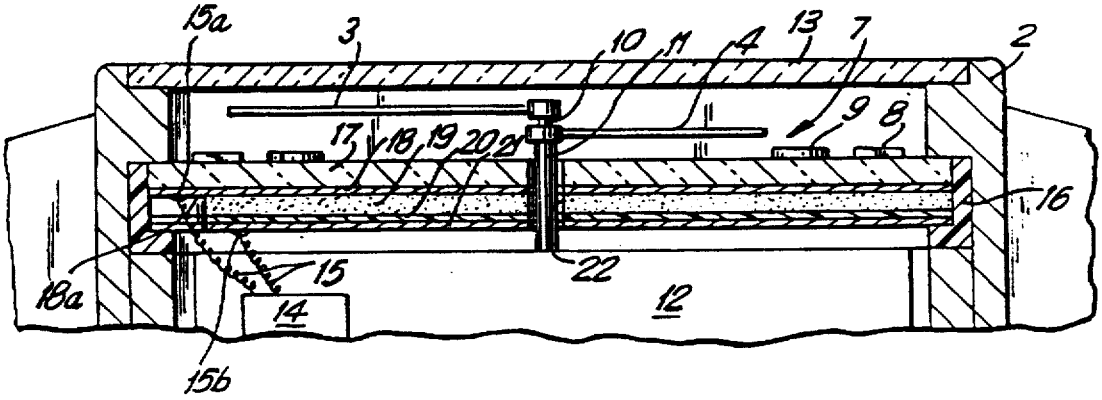
Fig. 1 Prior Art
Figure 2:
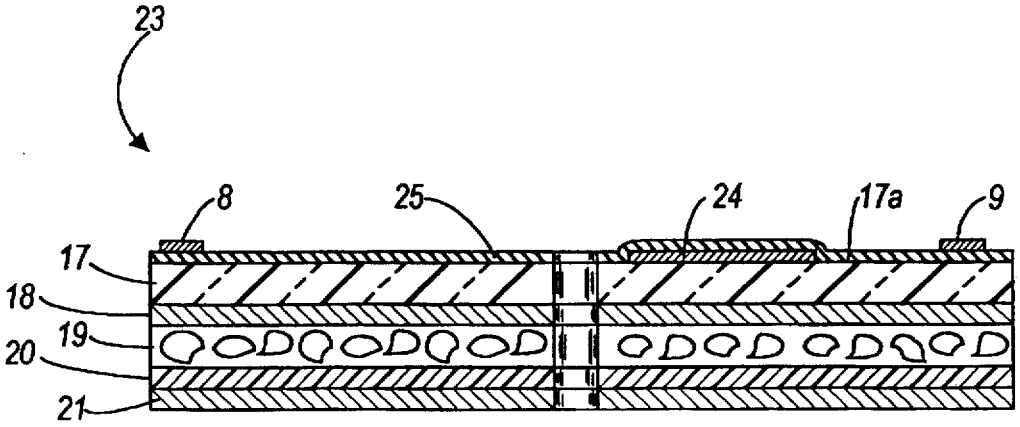

Referring now to FIG. 2 of the drawing, the improvement of the present invention may be described. Substrate 17 and layers 18, 19, 20 and 21 are constructed in the same manner as previously described to provide an electroluminescent lamp, shown generally as 23, adapted to serve as a dial for a timepiece and having an upper surface **17*a***.

In accordance with the present invention, one or more silhouette images designated as reference numeral 24 in FIG. 2 are applied to the upper surface **17*a* of substrate 17. Image 24 may be a design, logo, figure or image of any type comprising an opaque layer covering a portion of the upper surface. Silhouette image 24 may be applied by printing or painting on the upper surface, or by hot-stamping a foil, or it may be a separate pre-cut film of plastic or metal adhered to the upper surface 17*a* with an adhesive or by other suitable means. Preferably image 24** is an opaque ink of a color that will easily blend with the color of the electroluminescent lamp.

Subsequently, a transflective layer 25 is applied over the entire surface, covering also the silhouette image 24. Transflective layer 25 is sufficiently thin so as not to block the light from the electroluminescent layer 19, but sufficiently thick so as to hide the opaque image from view and reflect ambient light in the daytime. A preferred material for the transflective layer is vinyl ink or paint, 6–9 microns (0.006–0.009 mm) in thickness. Alternatively, a thin sheet of vinyl with adhesive back, such as used on stickers and decals, may be used. Lastly, opaque timekeeping indicia 8, 9 are applied on top of the transflective layer 25 by printing, silk screening or attaching with adhesive.

Figure 3:
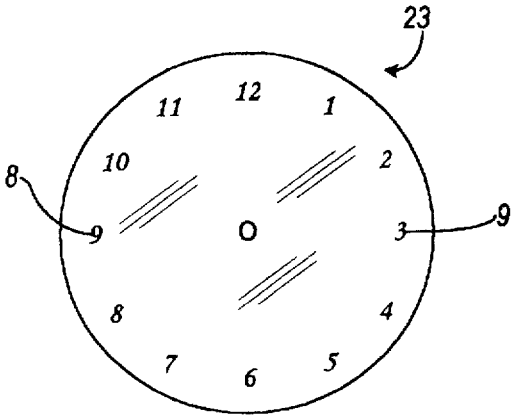
Figure 4:
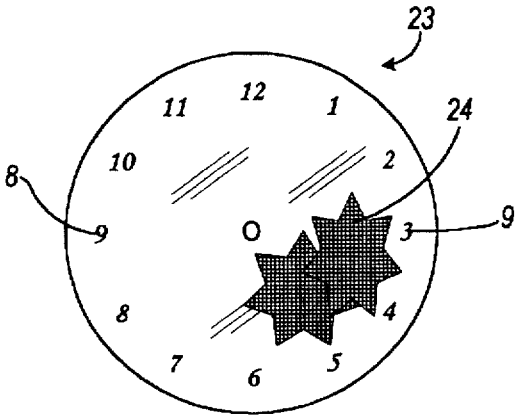
Figure 5:
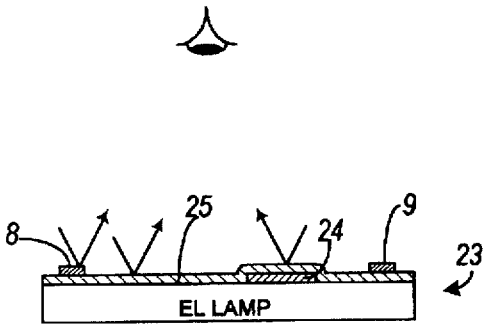
Figure 6:
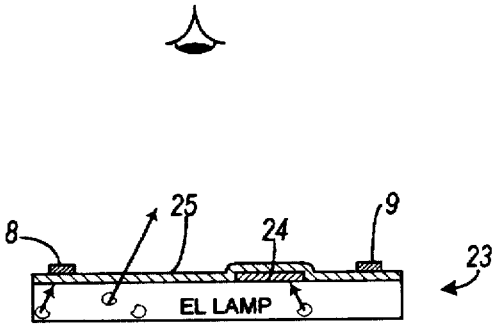

Referring now to FIGS. 3 and 4 of the drawing, top plan views are shown of the EL lamp 23 in the daytime and FIG. 4 when the EL lamp is illuminated. FIGS. 5 and 6 are simplified cross sectional views of EL lamp 23, wherein FIG. 5 corresponds to FIG. 3 in the daytime and FIG. 6 corresponds to FIG. 4 when the EL lamp is selectively illuminated.

Referring first to FIGS. 3 and 5, the transflective film or layer 25 reflects ambient light. Since it covers the silhouette image 24, the image is not visible. However timekeeping indicia 8, 9 are visible, since light from them is also reflected.

Referring to FIGS. 4 and 6, the transflective film 25 transmits light from the illuminated layer of the EL lamp to the eye as indicated by the arrow. However, light from the EL layer is blocked by the opaque image 24, as well as by the timekeeping indicia 8, 9. For this reason, both the silhouette image 24 and the timekeeping indicia 8, 9 will be visible at night.

By means of the described invention, logos, designs or pictures on the timepiece dial may be invisible from view during the daylight hours, but selectively displayed as silhouette images when the user actuates the electroluminescent lamp. Although the lamp is ordinarily actuated in the nighttime, the images are also visible in subdued ambient light at any time of day when the EL lamp is actuated.

While the invention has been described in connection with the preferred embodiment of an electroluminescent lamp, the invention is also applicable to other types of illuminated timepiece dials which may be selectively illuminated by a suitable light source.

While there has been described what is considered to be the preferred embodiment of the invention, other modifications will occur to those skilled in the art, and it is desired to secure in the appended claims all such modifications as fall within the true spirit and scope of the invention.

I claim:

1. A timepiece dial with an illuminated silhouette image comprising:

a lamp adapted to serve as the dial for a timepiece and having an upper surface, means for selectively illuminating said lamp to cause light to be emitted from its upper surface, a silhouette image comprising an opaque object covering a portion of said upper surface, a transflective layer covering said upper surface and said silhouette image, and opaque timekeeping indicia disposed on said transflective layer.

2. The combination according to claim 1, wherein the lamp is an electroluminescent lamp.

3. The combination according to claim 1, wherein the silhouette image opaque object comprises an opaque ink layer.

4. The combination according to claim 1, wherein the transflective layer comprises vinyl ink.

5. The combination according to claim 4, wherein the thickness of the vinyl ink transflective layer is on the order of 0.006 to 0.009 mm in thickness.

6. The combination according to claim 1, wherein the opaque timekeeping indicia are circumferentially spaced on the periphery of said transflective layer.

7. A timepiece dial with an illuminated silhouette image comprising:

an electroluminescent lamp adapted to serve as the dial for a timepiece and having an upper surface, means for selectively illuminating a silhouette image comprising an opaque ink layer covering a portion of said upper surface, a transflective layer comprising a thin layer of vinyl ink covering said upper surface and said silhouette image, and opaque timekeeping indicia circumferentially spaced on the periphery of said transflective layer.

* * * * *